US012137764B2

(12) United States Patent
Kansal

(10) Patent No.: US 12,137,764 B2
(45) Date of Patent: Nov. 12, 2024

(54) PROTECTIVE BAND FOR BALLISTIC HELMETS

(71) Applicant: Ashish Kansal, New Delhi (IN)

(72) Inventor: Ashish Kansal, New Delhi (IN)

( * ) Notice: Subject to any disclaimer, the term of this patent is extended or adjusted under 35 U.S.C. 154(b) by 299 days.

(21) Appl. No.: 17/604,457

(22) PCT Filed: Jul. 30, 2019

(86) PCT No.: PCT/IN2019/050560
§ 371 (c)(1),
(2) Date: Oct. 18, 2021

(87) PCT Pub. No.: WO2020/213000
PCT Pub. Date: Oct. 22, 2020

(65) Prior Publication Data

US 2022/0175073 A1 Jun. 9, 2022

(30) Foreign Application Priority Data

Apr. 18, 2019 (IN) ..... 201911015589

(51) Int. Cl.
*A42B 3/06* (2006.01)
*F41H 1/08* (2006.01)

(52) U.S. Cl.
CPC ..... *A42B 3/063* (2013.01); *F41H 1/08* (2013.01)

(58) Field of Classification Search
CPC ..... A42B 3/063; A42B 3/003; F41H 1/08; F41H 1/04
See application file for complete search history.

(56) References Cited

U.S. PATENT DOCUMENTS 4,091,469 A * 5/1978 Davidson ..... A42B 3/105 2/909
4,596,056 A * 6/1986 Grick ..... F41H 1/04 2/2.5
4,599,752 A * 7/1986 Mitchell ..... A42B 3/32 2/425
4,646,367 A * 3/1987 El Hassen ..... A42B 3/00 2/412
4,698,852 A * 10/1987 Romero ..... A42B 3/00 2/909
4,947,488 A * 8/1990 Ashinoff ..... A63B 71/10 2/DIG. 11
4,996,724 A * 3/1991 Dextrase ..... A42B 3/32 2/425
5,404,590 A * 4/1995 Monica, Jr. ..... A63B 71/1291 2/468
5,480,706 A * 1/1996 Li ..... B32B 5/12 428/920

(Continued)

FOREIGN PATENT DOCUMENTS

WO WO-2020213000 A1 * 10/2020 ..... A42B 3/063
WO WO-2020213001 A1 * 10/2020
WO WO-2022054070 A1 * 3/2022

*Primary Examiner* — Khaled Annis
(74) *Attorney, Agent, or Firm* — Jose Cherson Weissbrot

(57) ABSTRACT

A protective circular band assembly for helmets. The assembly includes a front portion, two side portions and one back portion as a single structure, wherein the front portion and back portion are curved from a top surface to form a curve wherein the two side portions are configured to adjust circumference of the assembly for different size helmets.

7 Claims, 3 Drawing Sheets

(56) References Cited

U.S. PATENT DOCUMENTS 5,946,734 A * 9/1999 Vogan ..... A63B 71/081 2/200.1
6,026,510 A * 2/2000 Kocher ..... F41H 1/02 2/2.5
6,272,692 B1 * 8/2001 Abraham ..... A42B 3/063 2/909
6,332,228 B1 * 12/2001 Takahara ..... A42B 3/003 2/425
8,166,573 B1 * 5/2012 Chung ..... A42B 3/32 2/425
10,006,743 B2 * 6/2018 Mitnick ..... A43B 3/0026
10,060,708 B2 * 8/2018 Andresen ..... A41D 13/018
10,215,538 B2 * 2/2019 Beard ..... B29C 70/207
10,539,398 B2 * 1/2020 Rodrigues ..... B32B 3/30
10,775,137 B2 * 9/2020 Ganor ..... B32B 9/005
11,226,178 B1 * 1/2022 Goepfert ..... F41H 5/007
11,660,846 B2 * 5/2023 Drzal ..... B32B 27/20 428/323
2003/0070209 A1 * 4/2003 Falone ..... B32B 7/022 2/463
2005/0166303 A1 * 8/2005 Aaron ..... A63B 71/10 2/2.5
2006/0248623 A1 * 11/2006 Miller ..... F41H 1/04 89/914
2008/0172779 A1 * 7/2008 Ferguson ..... A41D 31/285 2/455
2009/0064386 A1 * 3/2009 Rogers ..... A42B 3/125 2/200.1
2010/0031409 A1 * 2/2010 Norris ..... A42B 3/105 2/2.5
2011/0145964 A1 * 6/2011 Crye ..... F41H 1/02 2/2.5
2011/0203024 A1 * 8/2011 Morgan ..... F41H 1/04 2/2.5
2012/0186002 A1 * 7/2012 Bhatnagar ..... B32B 5/02 2/2.5
2013/0031692 A1 * 2/2013 Wratten ..... F41H 1/08 2/6.6
2013/0047309 A1 * 2/2013 Strum ..... F41H 1/04 2/2.5
2014/0023805 A1 * 1/2014 Greenhill ..... F41H 1/02 428/323
2015/0354925 A1 * 12/2015 Van Heerden ..... B32B 5/024 428/113
2016/0295935 A1 * 10/2016 Foster ..... A41D 19/002
2016/0320162 A1 * 11/2016 Whitney ..... F41H 5/023
2017/0251742 A1 * 9/2017 Partlo ..... F41H 1/04
2018/0304598 A1 * 10/2018 Drzal ..... F41H 1/08
2018/0335282 A1 * 11/2018 Ganor ..... A42B 3/06
2019/0128475 A1 * 5/2019 Roland ..... F17C 1/16
2019/0292101 A1 * 9/2019 Ihsan ..... B32B 5/18
2020/0368062 A1 * 11/2020 Baker ..... A61F 7/007
2021/0102313 A1 * 4/2021 Marissen ..... D01F 11/06
2021/0291486 A1 * 9/2021 Wagner ..... B32B 5/026
2021/0315304 A1 * 10/2021 Baker ..... A42B 3/06
2022/0175073 A1 * 6/2022 Kansal ..... F41H 1/08

* cited by examiner

PROTECTIVE BAND FOR BALLISTIC HELMETS

FIELD OF THE INVENTION

The present invention relates to ballistic helmets. More particularly, the invention relates to a protective band for bulletproof helmet.

BACKGROUND OF THE INVENTION

Bullet proof helmets have always been of high importance for safety of users. The quality of helmets has been a matter of concern when it comes to safety of the users. Depending on the requirement and expected bullet characteristics, the helmets require modification from manufacturing and design perspective. Some of the existing helmets can sustain an impact of bullet of 9×19 mm specification.

To improve on the quality of the helmets, the configuration and material properties of the helmet requires modification. The existing helmets are either extremely heavy due to multiple layer of metal being used during manufacturing or compromise on the quality of material to structure light weight helmets.

Further, in case of modification in technologies to improve the quality of protection the entire helmet needs to be replaced which is both costly and cumbersome process to undertake every time. Also, different types of helmet structures may be required for different environment considering the climate and other conditions during combat.

In view of the above problems associated with the prior art, there is a need of devices that overcomes the problems associated with the prior arts.

SUMMARY OF THE INVENTION

Accordingly, the present invention provides a protective circular band assembly configured to be accommodated on helmets of different types and shapes. The assembly includes a front portion, two side portions and one back portion as a single structure, wherein the front portion and back portion are curved from a top surface to form a curve wherein the two side portions are configured adjust circumference of the assembly for different size helmets.

In an advantageous aspect, the assembly of the present invention provides advanced ballistic, fragmentation and impact head protection with unsurpassed comfort for long-term safe use. It also improves the field of vision and hearing as there are no additional flanges required for strengthening the helmet surface thereby leading to better situational awareness.

In another advantageous aspect, the assembly of the invention has a low-profile structure to reduce risk of interference in target acquisition. It offers improved stability due to the circular structure. Also, the assembly is compatible with NVD's. NVG's, CBRN Gas Masks and communication devices. It provides protection from highly penetrative AK-47 and SS109 ammunition.

DETAILED DESCRIPTION OF THE PREFERRED EMBODIMENTS

Figure 1:
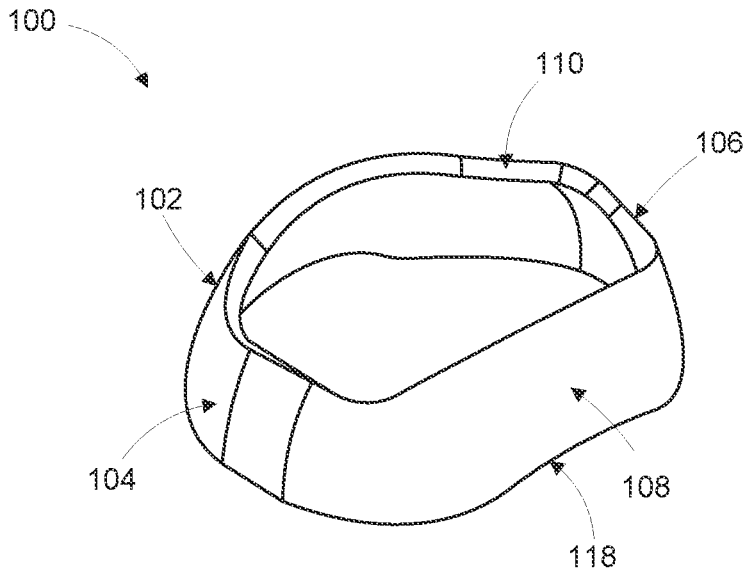
FIG. 1 shows a perspective view of a protective circular band assembly in accordance with embodiment of the present invention.

The various embodiments including the example embodiments will now be described more fully with reference to the accompanying drawings, in which the various embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components maybe exaggerated for clarity.

It will be understood that when an element or layer is referred to as being "on," "connected to," or "coupled to" another element or layer, it can be directly on, connected to, or coupled to the other element or layer or intervening elements or layers that may be present. As used herein, the term "and/or" includes any and all combinations of one or more of the associated listed items.

Spatially relative terms, such as "layer," "material," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures.

Embodiments described herein will refer to plan views and/or cross-sectional views by way of ideal schematic views. Accordingly, the views may be modified depending on simplistic assembling or manufacturing technologies and/or tolerances. Therefore, example embodiments are not limited to those shown in the views but include modifications in configurations formed on basis of assembling process. Therefore, regions exemplified in the figures have schematic properties and shapes of regions shown in the figures exemplify specific shapes or regions of elements, and do not limit the various embodiments including the example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, the various embodiments including the example embodiments relate to a protective helmet.

Figure 1A:
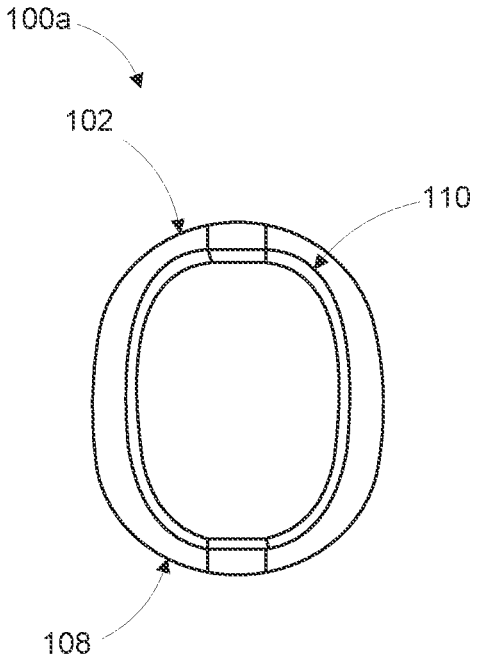
FIG. 1*a* shows a top view of the assembly in accordance with an embodiment of the present invention.
Figure 1B:
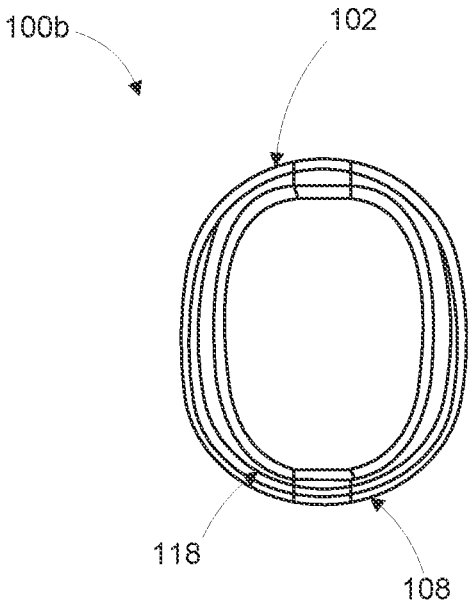
FIG. 1*b* shows a bottom view of the assembly in accordance with an embodiment of the present invention.
Figure 1C:
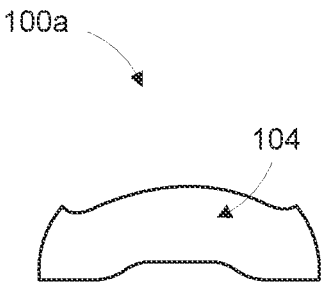
FIG. 1*c* shows a left view of the left side portion of the assembly in accordance with an embodiment of the present invention.
Figure 1D:
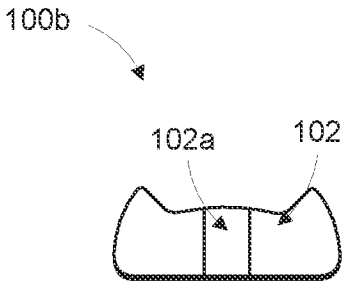
FIG. 1*d* shows a front view of the front side portion of the assembly in accordance with an embodiment of the present invention.
Figure 1E:
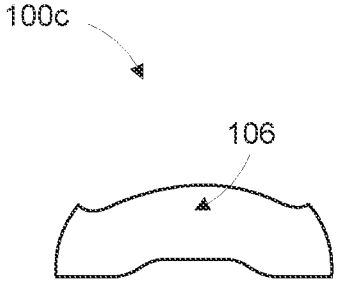
FIG. 1*e* shows a right view of the right-side portion of the assembly in accordance with an embodiment of the present invention.
Figure 1F:
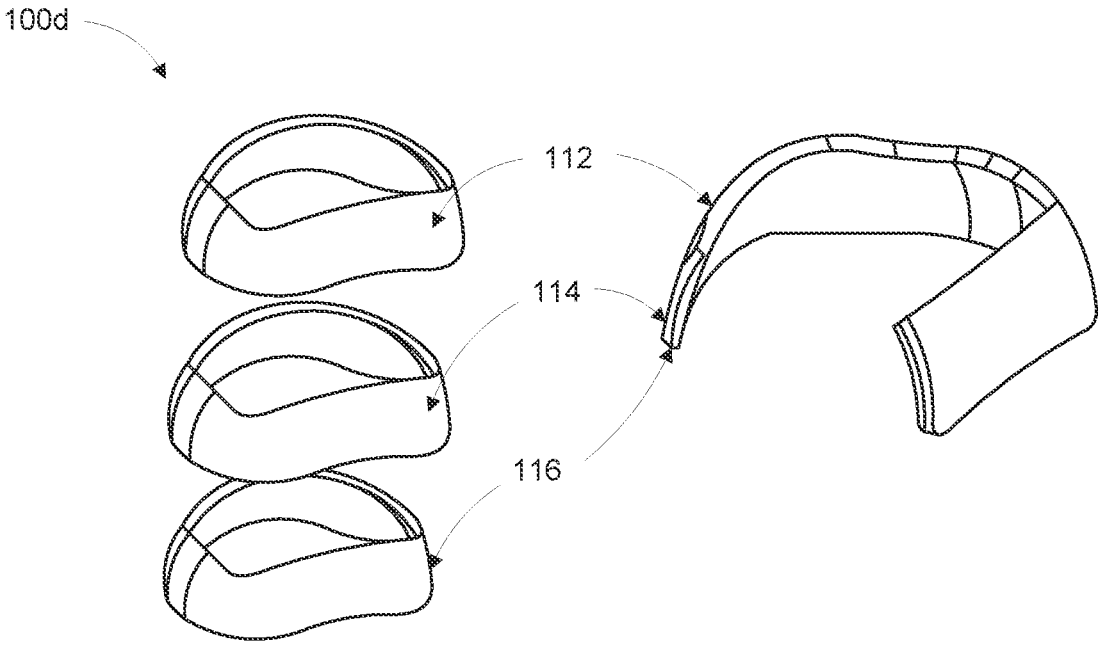
FIG. 1*f* shows a perspective view of the assembly with inner layer, outer layer and middle layer in accordance with an embodiment of the present invention.

Referring to FIG. 1-1*f* a protective circular band assembly 100 is provided in accordance with an embodiment of the present invention. The circular ceramic band assembly 100 is retrofitted on a helmet shell. The assembly 100 includes a front portion 102 (shown in front view 100*d* of FIG. 1*d*), two side portions (104, 106) (shown in side views 100*c* and 100*e* of FIGS. 1*c* and 1*e*) and one back portion 108 as a single structure. The front portion 104 and back portion 108 are curved from a top surface 110 (shown in top view 100*a* of FIG. 1*a*) to form a curve. The two side portions (104, 106) are configured to adjust circumference of the assembly 100 for different size helmet shell.

In an embodiment, the assembly 100 includes a hook and loop or adhesive to fix to the shell.

In an embodiment, a perspective view 100*f* of the assembly 100 is shown. The assembly includes an inner layer 112, an outer layer 114 and a middle layer 116 of manufacturing material with property providing high strength to the assembly. The inner layer is made of High-performance Polyethylene (HPPE) fabric/aramid fabric/high performance materials like nylon with high tensile strength. The outer layer 114 is made of fibre glass wrap and the middle layer 116 is of ceramic material. The entire assembly is made of bullet proof material to form a ballistic protective helmet.

In an exemplary embodiment the inner layer 112, outer layer 114 and middle layer 116 of the assembly 100 are of optimum thickness to form a matrix of material bonds imparting appropriate tensile strength for sustaining impact of a bullet and at the same time it is light weight thereby not increasing additional weight on the helmet.

In an exemplary embodiment, the assembly 100 is a removable assembly that can be fixed on any size helmet. Since, the type of helmets may vary due to changing conditions of combat, a standard removable assembly that can be fixed on any type of helmet is extremely desirable.

In an embodiment, each of the two side portions (104, 106) of the assembly 100 are curved from a bottom surface 118 (shown in bottom view 100*b* of FIG. 1*b*) to form an inverted curve thereby fitting to helmets of different sizes.

In an exemplary embodiment, the curved front portions 102 of the assembly 100 imparts optimum gripping properties to the assembly for fixing to the helmet appropriately. Also, the specific curved structure enables the user to have clear field visibility without any disruption unlike existing helmets with additional flanges. Also, the front portion 102 includes additional covering strip 102*a* to strengthen the part most exposed to a bullet range (FIG. 1*d*).

Figure 2:
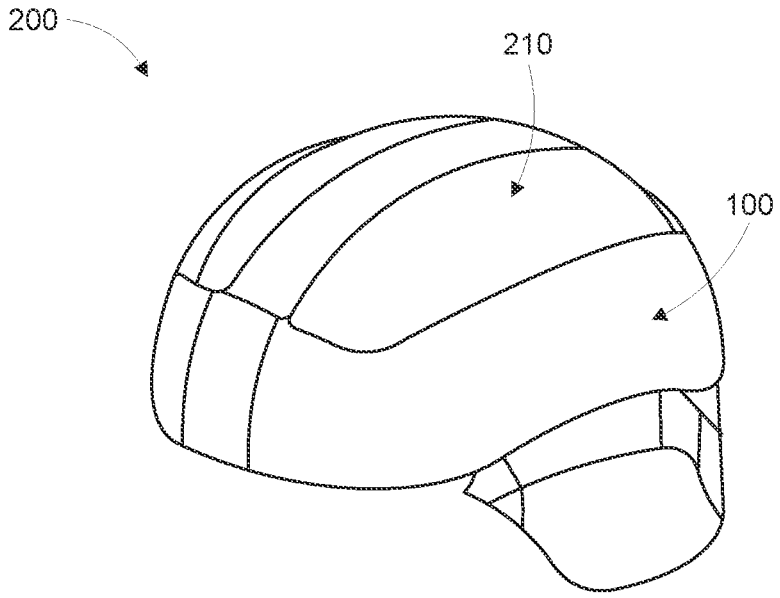
FIG. 2 shows a perspective front view of the assembly fitted with a helmet in accordance with an embodiment of the present invention.
Figure 2A:
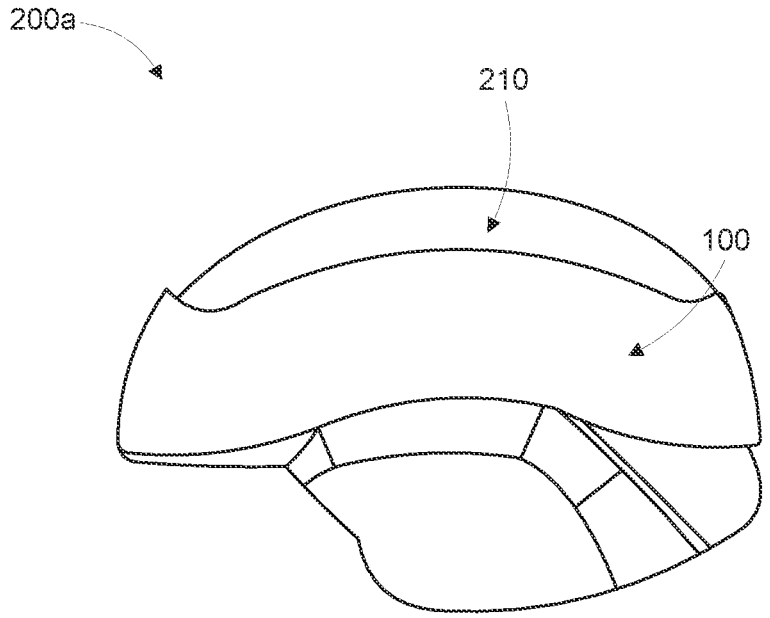
FIG. 2*a* shows a perspective side view of the assembly fitted with the helmet in accordance with an embodiment of the present invention.

As shown in front view 200 and side view 200*a* of FIGS. 2 and 2*a*, the present invention provides a protective helmet 210 fitted with the protective assembly 100 and configured to protect users against Rifle round i.e. AK 47 Hard Steel Core etc. ammunition with minimal back face deformation which should be less than 13 mm.

In an embodiment, the helmet is a level II/IIIA ballistic helmet capable of stopping 9 mm bullet/or 9 mm and 0.44 magnum bullets.

In an embodiment, the assembly of the present invention is Circular shape made of ceramics. The assembly includes a monolithic circular single piece ceramic, or it is made with plurality of ceramic pieces.

In an embodiment, the assembly is configured to withstand an impact from bullets of 7.62×39 mm HSC (hard steel core) fired from ammunition such as AK47 or bullets such as 7.62×51 mm NATO ball, 5.56 SS109/INSAS, 7.62×39 mm. MSC (Mild Steel Core) from an AK47 from a distance of 10 meters or more.

In an embodiment, an impact of the bullet with the assembly generates transfer of energy wherein at least one trauma pads accommodated inside the assembly are configured to keep the energy transfer to a minimum thereby controlling the trauma.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the claims.

I claim:

1. A protective circular band assembly for ballistic helmets, the assembly comprises: a front portion, two side portions and one back portion as a single structure, wherein the front portion and the back portion are curved from a top surface to form a curve wherein the two side portions are configured to adjust circumference of the assembly for different size helmets; wherein the assembly further comprises:

an inner layer made up of HPPE layer fabric, aramid fabric, and nylon;

a middle layer of ceramic; and an outer layer of fibre glass wrap, wherein the protective circular band assembly is configured to be removably assembled onto the ballistic helmets as the single structure.

2. The assembly of claim 1 wherein the inner layer, the outer layer and the middle layer of the assembly are of optimum thickness to form a matrix of material bonds imparting appropriate tensile strength for sustaining impact of a bullet and at the same time the assembly is light weight-bullet and/or 9 mm.

3. The assembly of claim 1 wherein each of the two side portions are configured to form an inverted curve and the assembly is removably fixed to helmets of different sizes and types depending on varying conditions of combat.

4. The assembly of claim 1 wherein the helmet is a level II/IIIA ballistic helmet capable of stopping 9 mm bullet and/or 9 mm and 0.44 magnum bullets.

5. The assembly of claim 4 wherein an impact of the bullet with the assembly generates transfer of energy, wherein at least one trauma pad accommodated inside the assembly are configured to keep the energy transfer to a minimum thereby controlling the trauma.

6. The assembly of claim 1 wherein the curved front portions of the assembly imparts optimum gripping properties to the assembly for fixing to the helmet appropriately wherein the curved structure enables the user to have clear field visibility without any disruption from additional flanges.

7. The assembly of claim 1 wherein the assembly is configured to withstand an impact from bullets of 7.62×39 mm HSC (hard steel core) fired from ammunition for example AK47 or bullets 7.62×51 mm NATO ball, 5.56 SS109/INSAS, 7.62×39 mm, MSC (Mild Steel Core) from an AK47 from a distance of 10 metres.

* * * * *